US006793070B2

(12) United States Patent
Dye

(10) Patent No.: US 6,793,070 B2
(45) Date of Patent: Sep. 21, 2004

(54) SHIPPING AND DISPLAY CASE

(75) Inventor: Robert George Dye, Glen Ridge, NJ (US)

(73) Assignee: Stone Container Corporation, Chicago, IL (US)

( * ) Notice: Subject to any disclaimer, the term of this patent is extended or adjusted under 35 U.S.C. 154(b) by 233 days.

(21) Appl. No.: 10/194,331

(22) Filed: Jul. 12, 2002

(65) Prior Publication Data

US 2004/0007495 A1 Jan. 15, 2004

(51) Int. Cl.[7] ..... B65D 25/24

(52) U.S. Cl. ..... 206/45.24; 211/88.01; 53/452; 220/482; 229/164; 248/311.2

(58) Field of Search ..... 206/45.24, 525, 206/806; 211/88.01, 113; 220/480–482; 53/452, 473; 229/117.09, 117.18, 164, 933; 248/220.21, 220.31, 220.41, 224.7, 311.2, 312.1

(56) References Cited

U.S. PATENT DOCUMENTS 2,770,513 A * 11/1956 Brown ..... 220/482
2,812,852 A * 11/1957 Samuels ..... 211/88.01
3,193,108 A * 7/1965 Johnson ..... 206/806
4,353,496 A * 10/1982 Nelson et al. ..... 229/164
4,687,094 A 8/1987 Allsop et al.
4,753,341 A * 6/1988 McIntyre ..... 229/164
5,180,052 A * 1/1993 Smith et al. ..... 229/164
6,302,323 B1 * 10/2001 Southwell ..... 229/164
6,557,711 B2 * 5/2003 Grueneberg ..... 211/88.01

* cited by examiner

*Primary Examiner*—Luan K. Bui
(74) *Attorney, Agent, or Firm*—Greenberg & Traurig

(57) ABSTRACT

A shipping case and display apparatus for transporting articles to a display and vending location, comprising a blank having bottom, rear, side and front panels therein, and further having a hook for releasably attaching said apparatus to a pegboard. Upon articulating the blank into a tray, the hook may be positioned in an undeployed orientation in a rear panel region, and the tray may be stocked with articles and sleeved for shipping. Upon arrival at the vending location, the hook may be positioned in a deployed orientation, the shelf may then be hung on a pegboard and the sleeve may then be removed.

15 Claims, 19 Drawing Sheets

SHIPPING AND DISPLAY CASE

BACKGROUND OF THE INVENTION

1. Field of the Invention

The present invention relates to shipping cases, in particular shipping cases that are fabricated at least in part from paper, paperboard and/or corrugated paperboard material, and which can be configured to serve as a display apparatus for the shipped goods.

2. Prior Art

In stores which deal with dry goods that are sold in their own individual containers, such as grocery or warehouse stores, store personnel typically must open the shipping cases in which the goods have been shipped from the supplier, individually place each article on the shelf, and then arrange them neatly for presentation. Such cases are often structures dedicated solely to a shipping function, and when opened, are either destroyed or result in an open-topped case poorly suited for merchandising functions.

In addition, this process of individual removal of articles from a shipping case, and placement on shelves, is relatively costly to the store in terms of personnel effort, time, wages, etc. Therefore, it has become desirable to reduce costs associated with placing shipped goods on display.

This has resulted in the development of a variety of cases that are configured to be convertible from a shipping configuration into a display configuration, which permits the converted case to be placed directly upon a shelf, or floor display, without having to remove the individual articles from the case. This is usually accomplished by providing the case with removable or cut-out portions of the case that create apertures through which customers may then help themselves to the articles within the converted case.

However, such prior art shipping and display cases often must be placed on a shelf. As a result, store personnel must spend time setting up and configuring shelving to support the shipping and display cases. Shelving configurations, or "planograms," often are changed by vendors in accordance with advertising and inventory needs. Thus, vendors spend considerable time removing products from shelves, adjusting the configuration of shelves and restocking shelves. Shelving units often consist of a series of shelf support standards separated by pegboards.

It is accordingly desirable to provide a shipping case and display apparatus in the form of a tray that provides its own support without having to be placed on a shelf. It is further desirable to provide a display apparatus which may be easily moved within or between shelving units without having to remove articles from the display apparatus. In addition, it is desirable for the display apparatus to function as a shipping case, in which the articles are pre-arranged for display at the place of manufacture.

These and other desirable characteristics of the present invention will become apparent in view of the present specification and drawings.

SUMMARY OF THE INVENTION

The present invention comprises, in part, a shipping case and display apparatus for transporting and displaying articles, which is operably configured to be hung from a pegboard.

In a preferred embodiment of the invention, the shipping case and display apparatus comprises a tray, having a bottom panel, a pair of side panels and a rear panel region formed by outer, top and inner rear panels, wherein the panels are foldably connected to at least one of the other panels. The tray also includes a hook. The hook is positionable in an undeployed orientation, where the hook is substantially enclosed by the rear panel region. The hook is alternately positionable in a deployed orientation, where at least one hook end extends through a corresponding aperture in the top rear panel.

In a further embodiment of the invention, the outer rear panel includes a hook slot, through which the hook may be inserted in the apparatus, and at least one hook support tab for retaining the hook in its deployed orientation.

In an additional embodiment of the present invention, the hook is restrained in its second, extended position by the at least one hook support tab, by the inner rear panel, and by the top rear panel.

In yet a further embodiment, the at least one hook support tab engages the base of the hook. The top rear panel engages a support member of the hook and the inner rear panel engages a front portion of the hook.

In a different embodiment of the present invention, the tray may comprise a front panel.

A hook in accordance with the present invention is comprised of a base portion, a front portion, first and second hook ends, and a support member. Each hook end is in the shape of a partial "S", as commonly used in the pegboard industry. Each hook end has a hook end base, and the support member extends from a base of the first hook end to a base of the second hook end.

A further embodiment of the present invention comprises a sleeve which can slide over the tray, for protecting the tray's contents for shipping. The sleeve is a five-sided box, having top and bottom panels, a pair of side panels, and a rear panel formed by a set of flaps.

In other embodiments, the sleeve may include at least one of strap notches and hook notches.

The present invention also comprises a blank for articulating a tray for a shipping case and display apparatus. The blank is comprised of a bottom panel and an outer rear panel, foldably connected to the bottom panel. A pair of outer side panel dividers are foldably connected to opposite edges of the outer rear panel. A top panel is foldably connected to the outer rear panel, while an inner rear panel is foldably connected to the top rear panel. A pair of inner side panel dividers is further foldably connected to opposite edges of the inner rear panel, with an inner front panel divider foldably connected to each of the inner side panel dividers. Side panels, including an outer portion, a top portion, and an inner portion, are foldably connected to opposite edges of the bottom panel. Outer front panel dividers are foldably connected to the front of the outer portion of each side panel. A front panel, including an outer portion, a top portion, and an inner portion, is foldably connected to the remaining edge of the bottom panel. The bottom panel also includes a pair of front panel apertures, side panel apertures, hook apertures, a hook slot, and a pair of hook support tabs, as well as a plurality of fold lines.

In another embodiment of the invention, the blank is formed from a single blank of material, which may be any one of paper, paper board, or corrugated cardboard.

The present invention also comprises a method for shipping and displaying articles. First, a flat blank is provided for articulating a tray. The blank is then articulated into a tray having a bottom panel, a pair of side panels, and a rear panel region defined by an outer, top and inner rear panel. A hook is introduced into the rear panel region. Next, the hook is positioned in an undeployed orientation wherein all but a portion of the hook is enclosed within the rear panel region. The tray is then loaded with articles. A sleeve, in the form of a five-sided box, is then provided. The sleeve is slid over the tray and its contents, and the tray and sleeve are bound together by a strap. The combined shipping and display apparatus is then shipped to a vendor, where it is received. The vendor positions the hook in its deployed orientation, where at least one hook end protrudes through a corresponding hook aperture in the top rear panel. The shipping and display apparatus is then hung from a support surface by inserting the at least one hook end in a corresponding hook engaging aperture. Once the shipping and display apparatus is hung, the strap and sleeve may be removed, exposing the articles.

In alternative embodiments of the preferred method, the hook may either be inserted into the tray before or after the tray is articulated.

DETAILED DESCRIPTION OF THE DRAWINGS

Figure 1A:
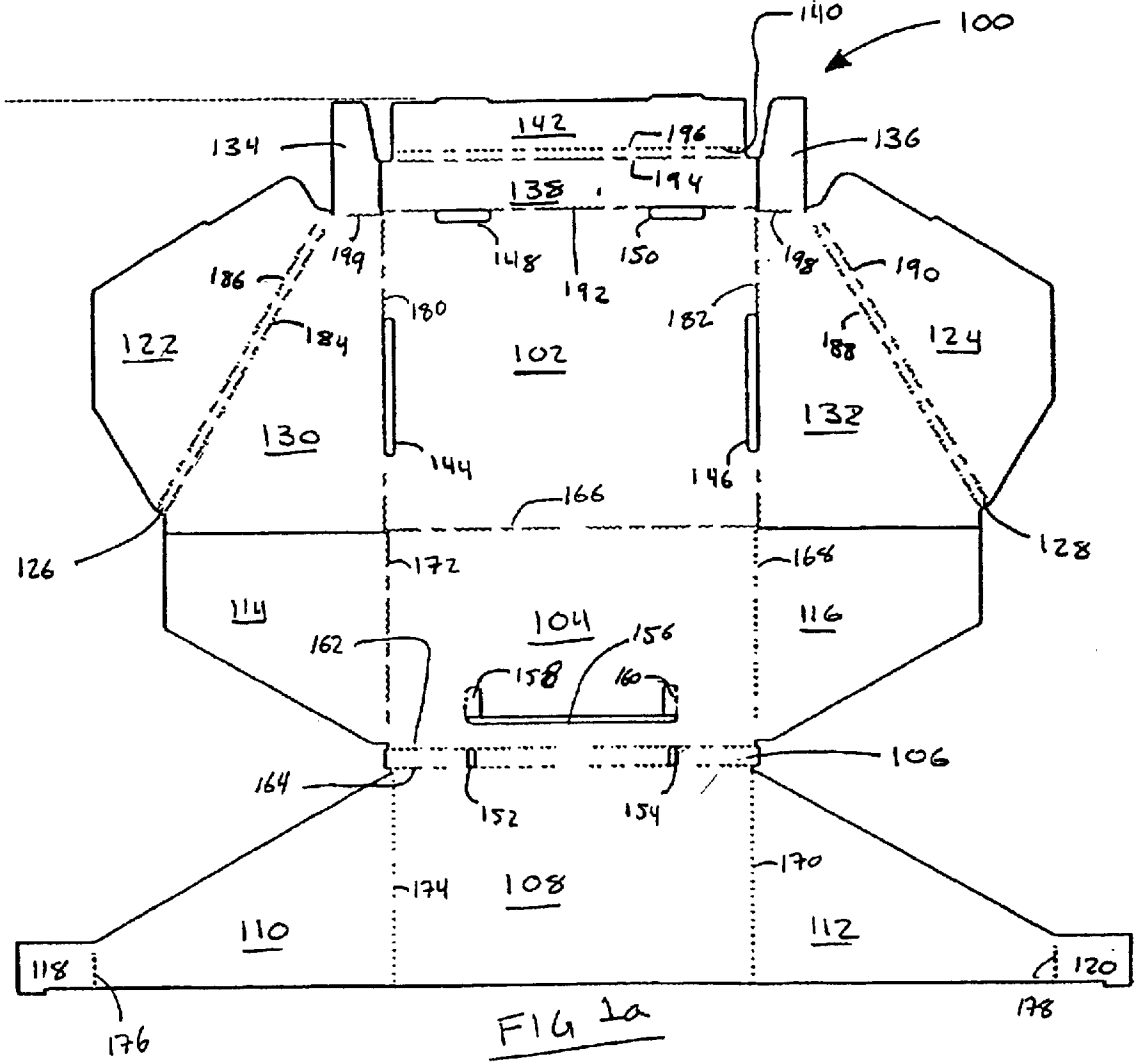
FIG. 1A is a blank for a tray portion of a shipping case and display apparatus according to a preferred embodiment of the invention.

While this invention is susceptible of embodiment in many different forms, there is shown in the drawings and will be described herein in detail, a specific embodiment, with the understanding that the present invention is to be considered an exemplification of the principals of the invention and is not intended to limit the invention to the embodiment illustrated.

In the present disclosure, unless otherwise expressly noted or apparent from the disclosure, the convention applies that broken lines shown in the interior of a paperboard blank represent creases, perforations, fold lines or similar lines of weakness, while solid continuous lines shown in the interior of a paperboard blank represent continuous cuts through the blank material, or the boundary of an aperture in the blank.

Figure 1B:
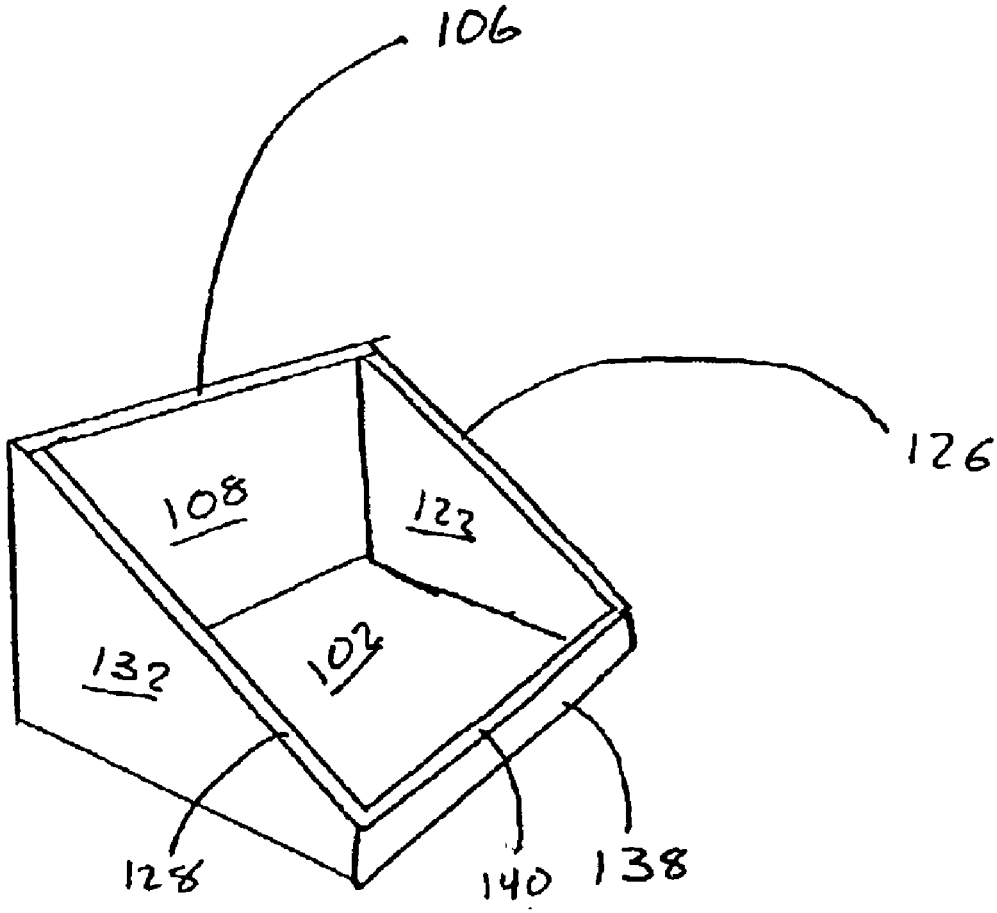
FIG. 1B is a perspective view of an articulated tray.

FIG. 1A illustrates blank 100 for articulating into a tray portion of the present invention, the articulated form of which is shown in FIG. 1B. The blank includes bottom panel 102, outer rear panel 104, top rear panel 106, inner rear panel 108, inner side dividers 110, 112, outer side dividers 114, 116, inner front panel dividers 118, 120, inner side panels 122, 124, top side panels 126, 128, outer side panels 130, 132, outer front panel dividers 134, 136, outer front panel 138, top front panel 140, and inner front panel 142. The blank 100 additionally includes side panel slots 144, 146, front panel slots 148, 150, hook apertures 152, 154, hook slot 156, and hook retaining tabs 158, 160, as well as fold lines 162–199.

In a preferred embodiment of the invention, blank 100 is fabricated from corrugated paperboard material. One preferred material is EB double wall material as is referred to by those of ordinary skill in the art of fabricating corrugated paper board cases, although other material profiles may be employed, using any single wall flute profile (eg. A, C, B, E, F, G, K, L, M, N, and S) or their various double wall permutations (eg. AC, BC, EC, EB, AB, CB, LE, BN, etc.). Other materials may be employed, as desired or required by the needs of a particular application of the design.

Figure 2:
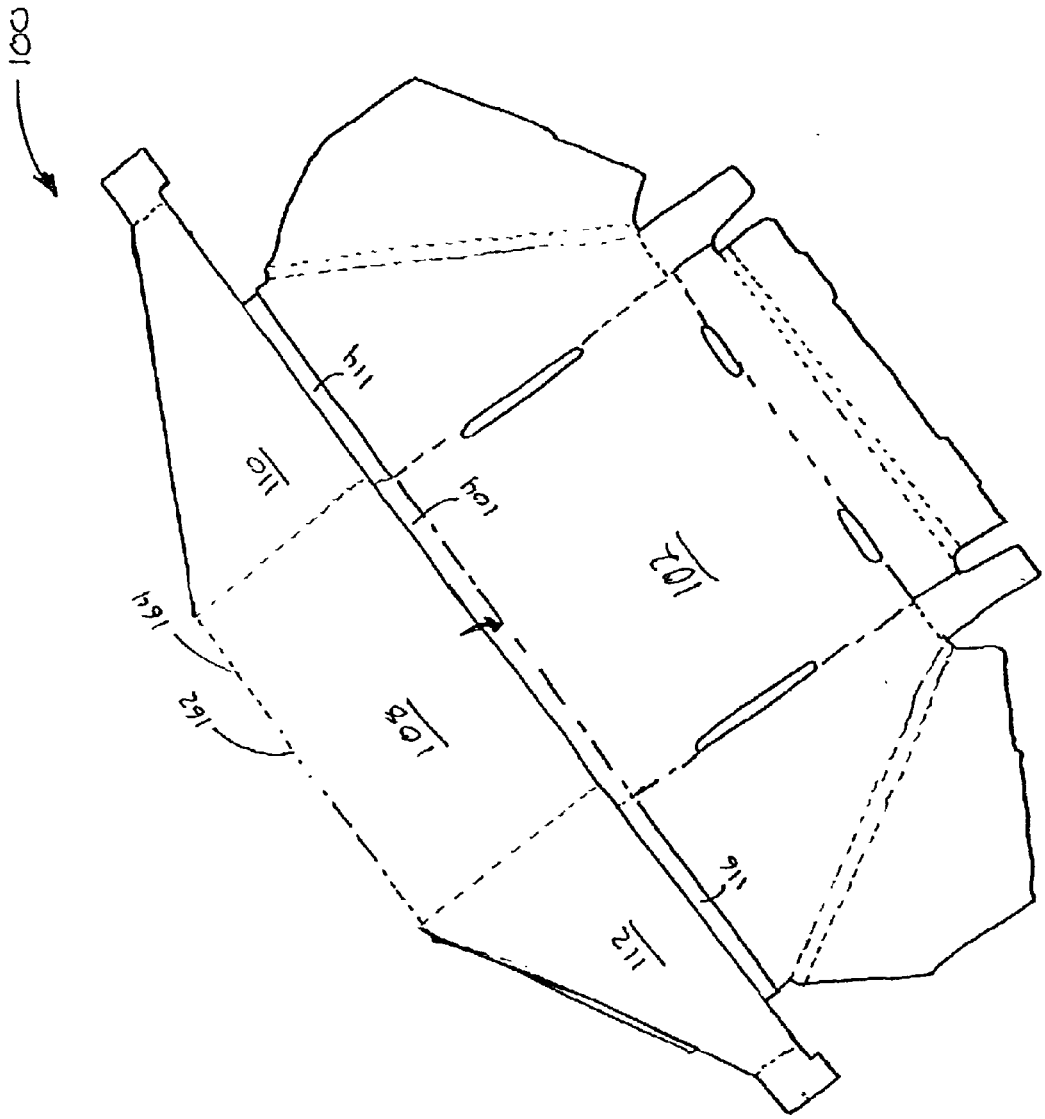
FIG. 2 illustrates a first step in the articulation and set-up of the tray according to the embodiment of FIG. 1.

Turning to FIG. 2, blank 100 is articulated by first folding inner rear panel 108 towards outer rear panel 104 along lines 162, 164. When folded properly, inner rear panel 108 and inner side dividers 110, 112 should overlay outer rear panel 104 and outer side dividers 114, 116, respectively.

Figure 3:
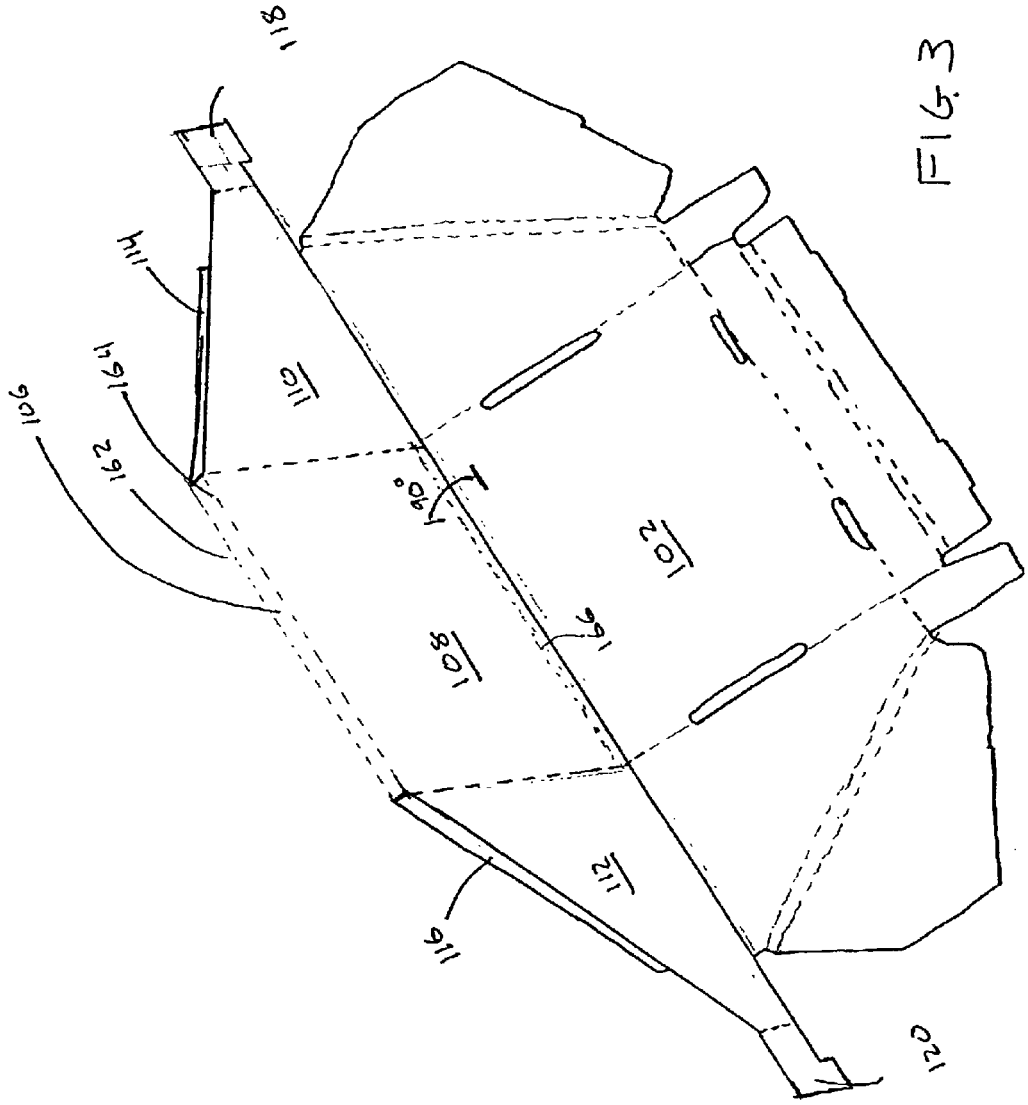
FIG. 3 illustrates a second step in the articulation and set-up of the tray according to the embodiment of FIG. 1.

Referring to FIG. 3, outer rear panel 104 (not shown) and inner rear panel 108 are then folded along line 166 towards bottom panel 102 so that outer rear panel 104 and inner rear panel 108 are perpendicular to bottom panel 102.

Figure 4:
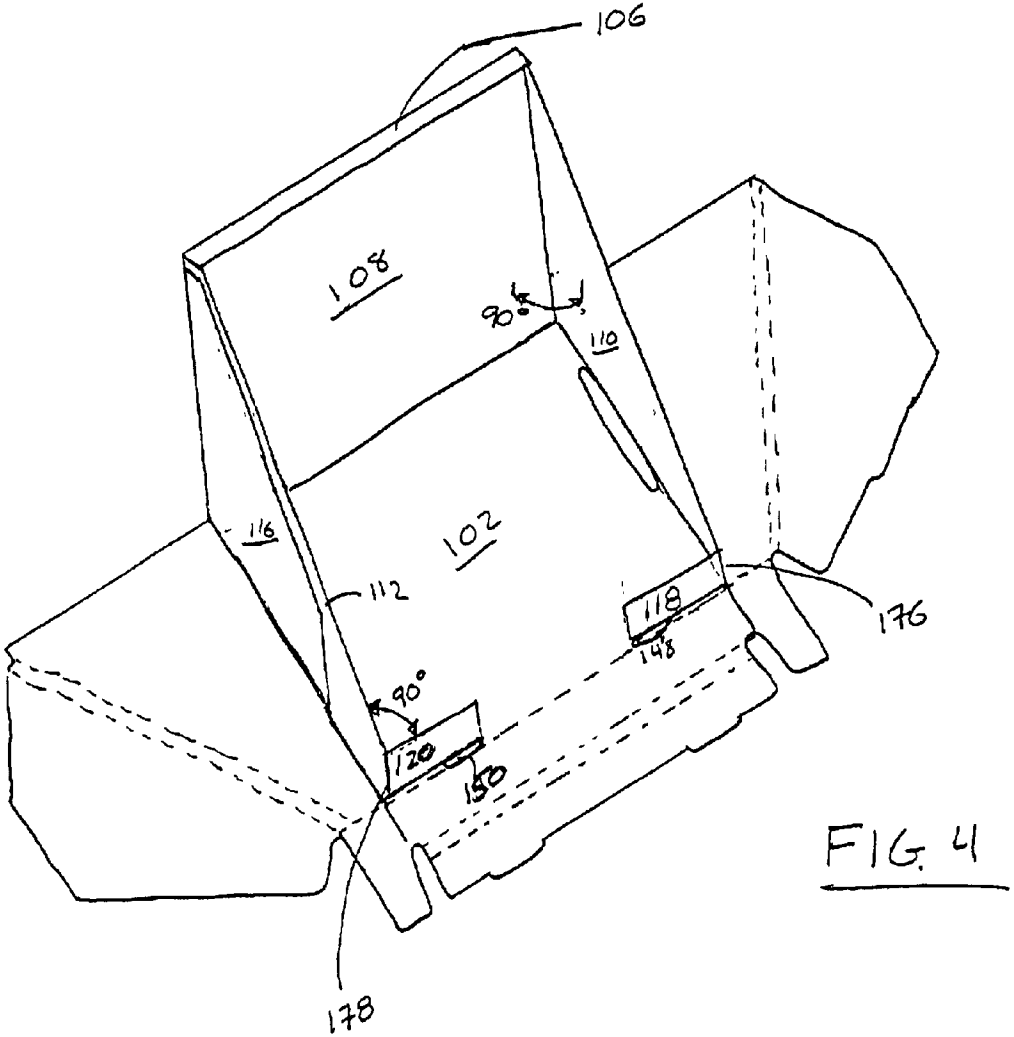
FIG. 4 illustrates a third step in the articulation and set-up of the tray according to the embodiment of FIG. 1.

Next, as shown in FIG. 4, inner side dividers 110, 112 as well as outer side dividers 114 (not shown), 116, are folded inwards by ninety degrees (90°), along lines 168, 170, 172, 174 (shown in FIG. 1). Inner front panel dividers 118, 120 are then folded inward by ninety degrees (90°) along lines 176, 178, and are inserted into front panel slots 148, 150.

Figure 5:
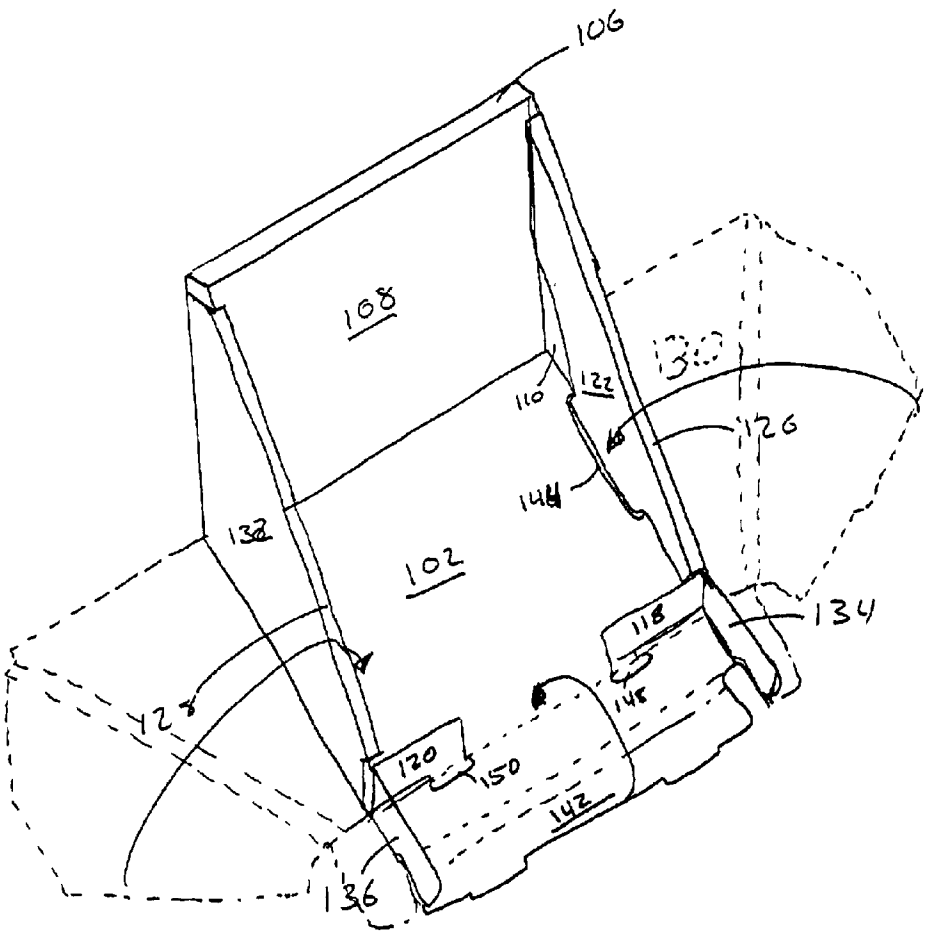
FIG. 5 illustrates a fourth step in the articulation and set-up of the tray according to the embodiment of FIG. 1.

Turning to FIG. 5, outer side panels 130 (shown in FIG. 1), 132 are then folded upward along lines 180, 182 (shown in FIG. 1) until they are parallel to outer side dividers 114, 116 and inner side dividers 110, 112, respectively. Inner side panels 122, 124 are then folded along side ridges 126, 128 over inner side dividers 110, 112 as well as outer side dividers 114, 116. The inner side panels 122, 124 are then inserted into side panel slots 144, 146.

Figure 6:
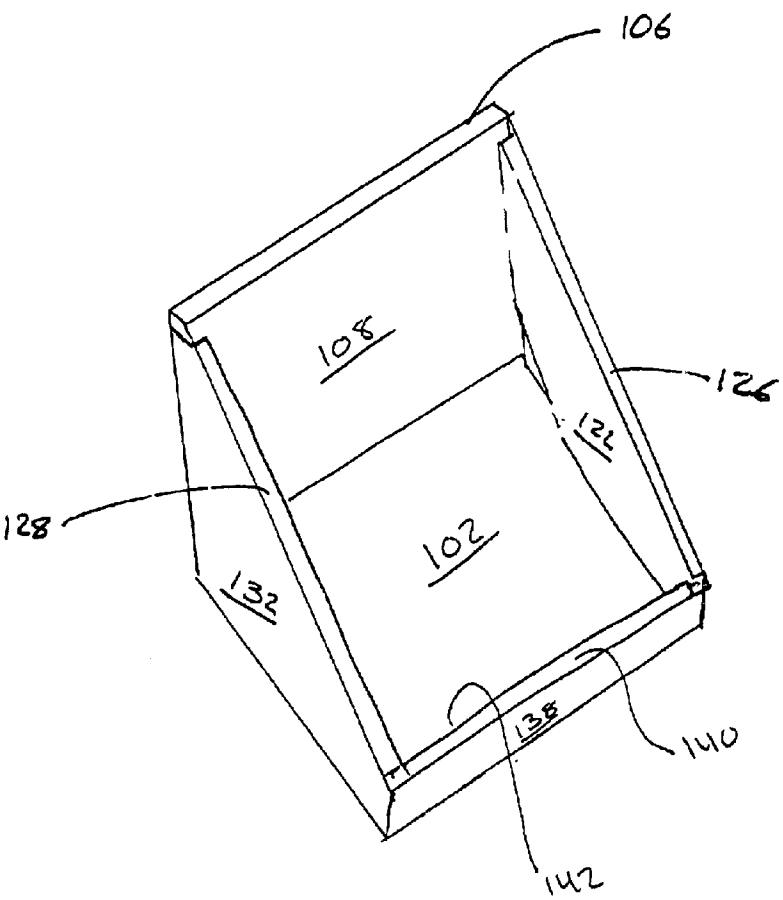
FIG. 6 illustrates a fifth step in the articulation and set-up of the tray according to the embodiment of FIG. 1.

Outer front panel dividers 134, 136 are then folded inward by ninety degrees (90°) until they are parallel to inner front panel dividers 118, 120. Inner front panel 142 is then folded over inner front panel dividers 118, 120 and outer front panel dividers 134, 136, and inserted into front panel slots and 148 and 150. The resulting articulated shape is that of a tray as shown in FIG. 6.

Figure 7B:
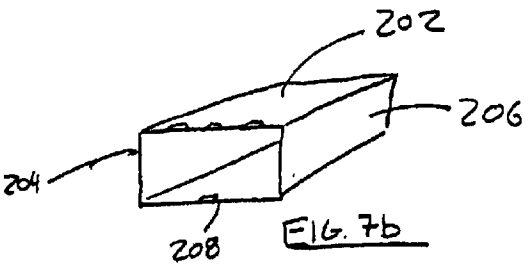
FIG. 7B is a perspective view of an articulated sleeve for a tray according to a preferred embodiment of the invention.
Figure 7A:
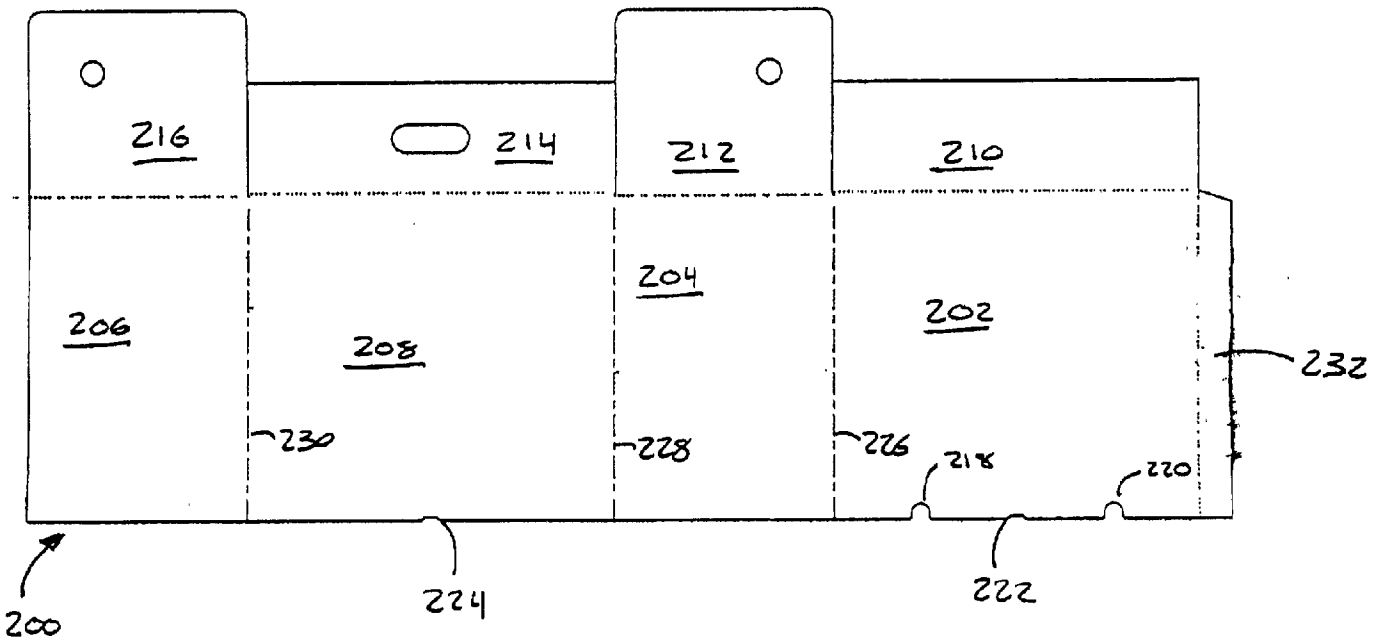
FIG. 7A is a blank for a sleeve for a tray according to a preferred embodiment of the invention.

FIG. 7*a* illustrates blank 200 for articulating a sleeve, the articulated form of which is shown in FIG. 7*b*. Blank 200 comprises top panel 202, side panels 204, 206 and bottom panel 208. The sleeve 200 additionally comprises rear panels 210, 212, 214, 216, hook notches 218, 220, strap notches 222, 224 and glue flap 232.

Blank 200 is articulated by folding first side panel 202 ninety degrees (90°) along line 226, folding bottom panel 208 ninety degrees (90°) along line 228, folding second side panel 206 ninety degrees (90°) along line 230, and securing second side panel 206 to top panel 202 via glue flap 232. Rear panels 210, 212, 214, 216 are then folded inward in sequential order. The resulting articulated shape is that of a five-sided box having one open end.

While glue flap 232 is the preferred means for securing second side panel 206 to top panel 202, other attachment means may be employed. For example, staples or tape may alternatively be used for securing second side panel 206 to top panel 202. Likewise, rear panels 210, 212, 214, 216 may be secured together by a variety of means, including staples, glue flaps, tape or folding action.

Figure 8:
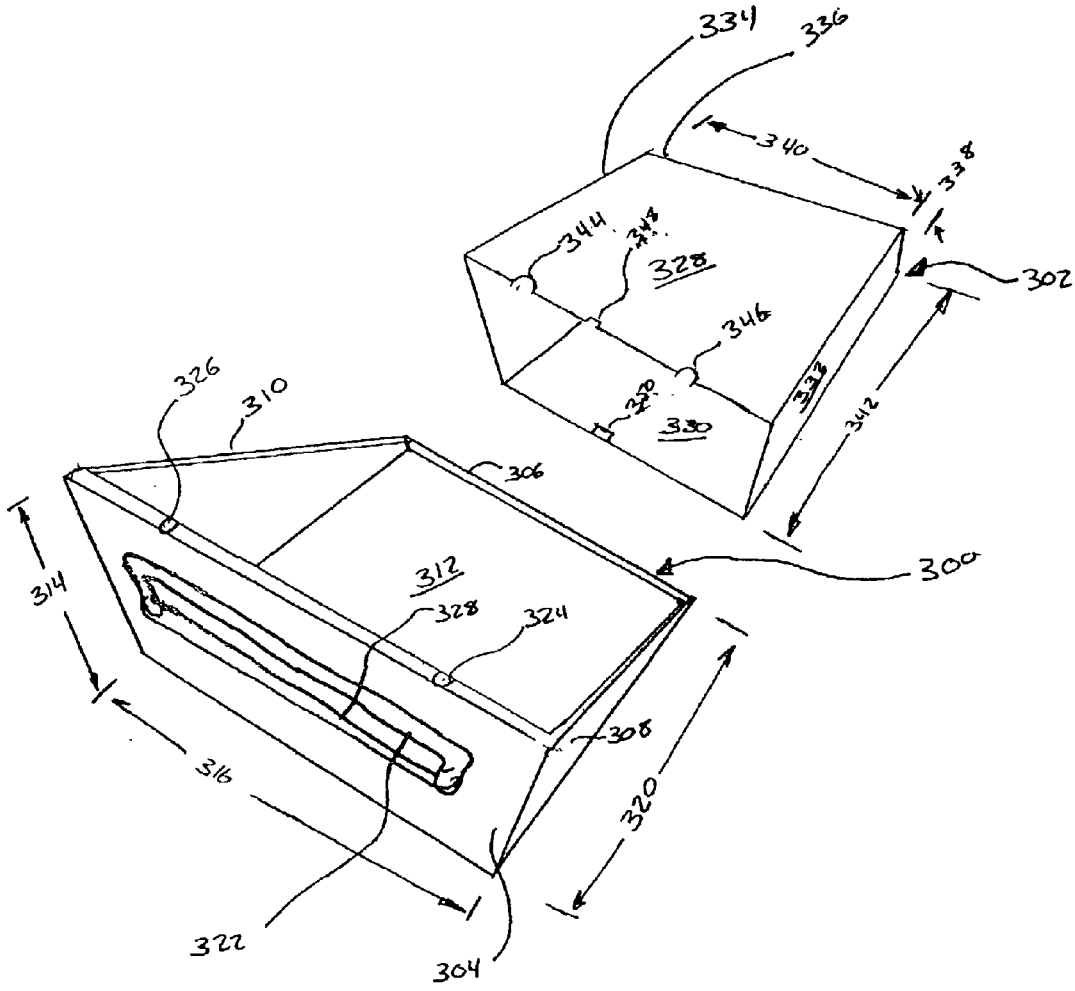
FIG. 8 is a perspective view of both a tray and a sleeve, according to a preferred embodiment of the invention.

Articulated tray 300 and sleeve 302 are shown in FIG. 8. The tray 300 has rear end 304, front end 306, two sides 308, 310, and bottom 312. The tray 300 also has height 314, width 316, and length 320. Rear end 304 of the tray 300 includes slot 322 and two hook apertures 324, 326. Hook 328 is disposed in hook slot 322.

Sleeve 302 has top 328, bottom 330, two sides 332, 334, and rear 336, which cooperate to define a five-sided box having one open end. Sleeve 302 also has height 338, width 340, and length 342. Sleeve 302 additionally includes hook notches 344, 346 corresponding to hook apertures 324, 326, as well as strap notches 348, 350.

Tray height 314 is configured to be slightly less than sleeve height 338. Similarly, tray width 316 is slightly less than sleeve width 340, and tray length 318 is slightly less than sleeve length 342. Because the tray's dimensions are slightly smaller than those of the sleeve, the sleeve is capable of slidably receiving the tray.

Figure 9:
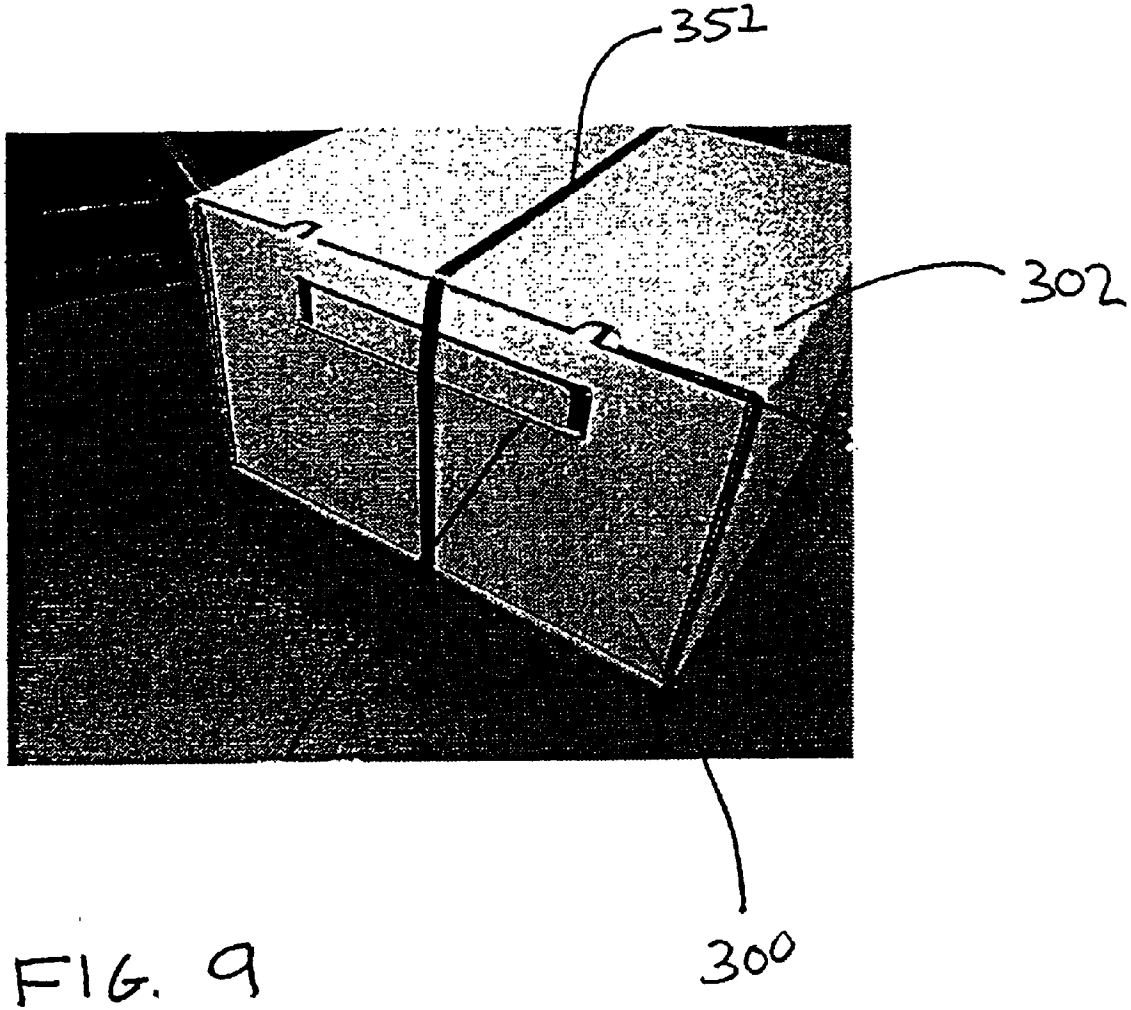
FIG. 9 is a perspective view of an assembled shipping case and display apparatus.

When sleeve 302 slidably receives tray 300, hook notches 344, 346 on sleeve 302 align with hook apertures 324, 326 on tray 300, allowing tray 300 to be completely inserted into sleeve 302. Strap 351, shown in FIG. 9, may then be wrapped around both sleeve 302 and tray 300 in order to secure two components together, forming an assembled shipping case and display apparatus. Strap 351 passes through strap notches 348, 350 (shown in FIG. 8) ensuring that tray 300 is tightly secured in sleeve 302.

Figure 10:
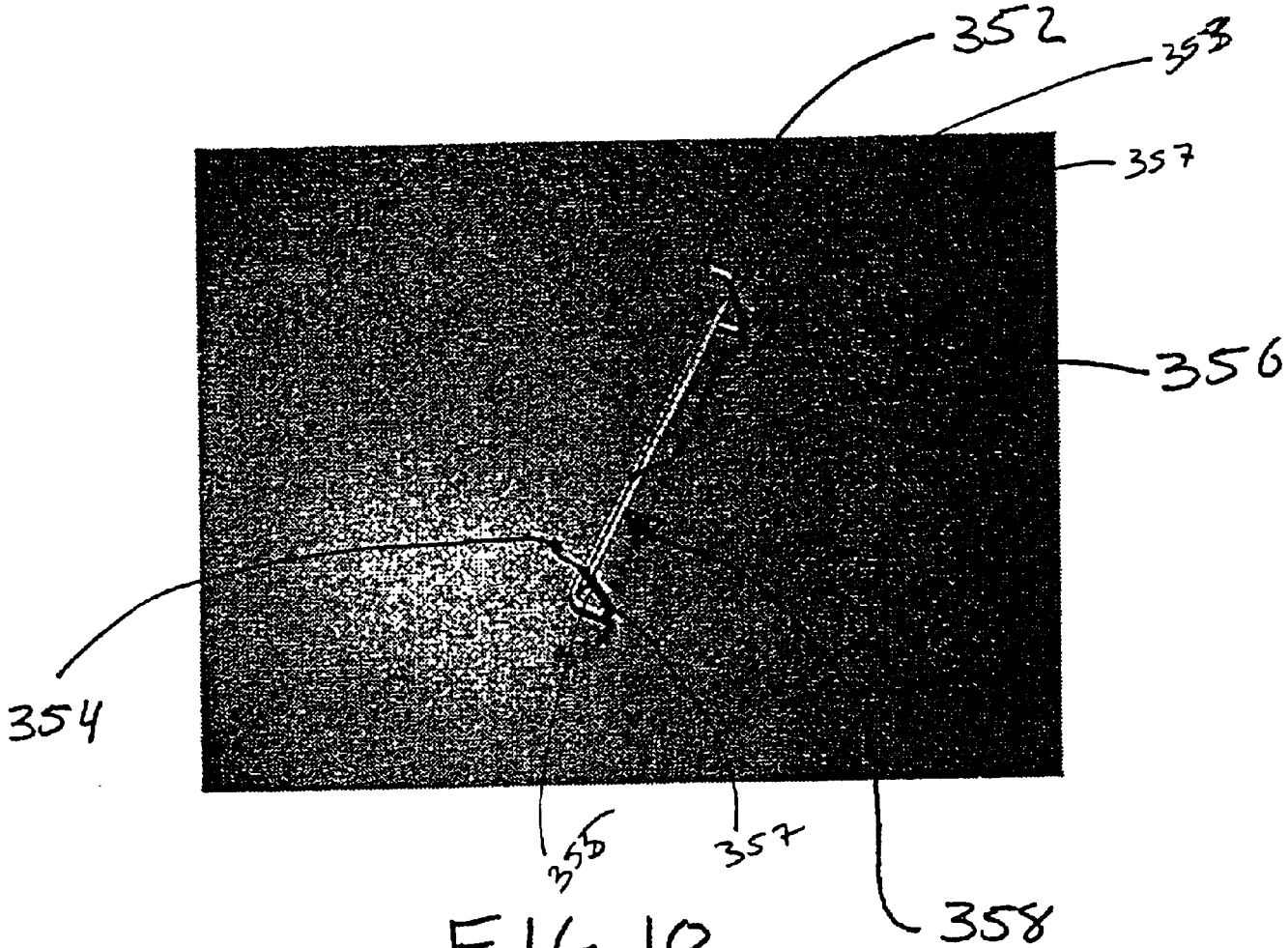
FIG. 10 is a perspective view of a pegboard hook for a shipping case and display apparatus according to a preferred embodiment of the invention.
Figure 11:
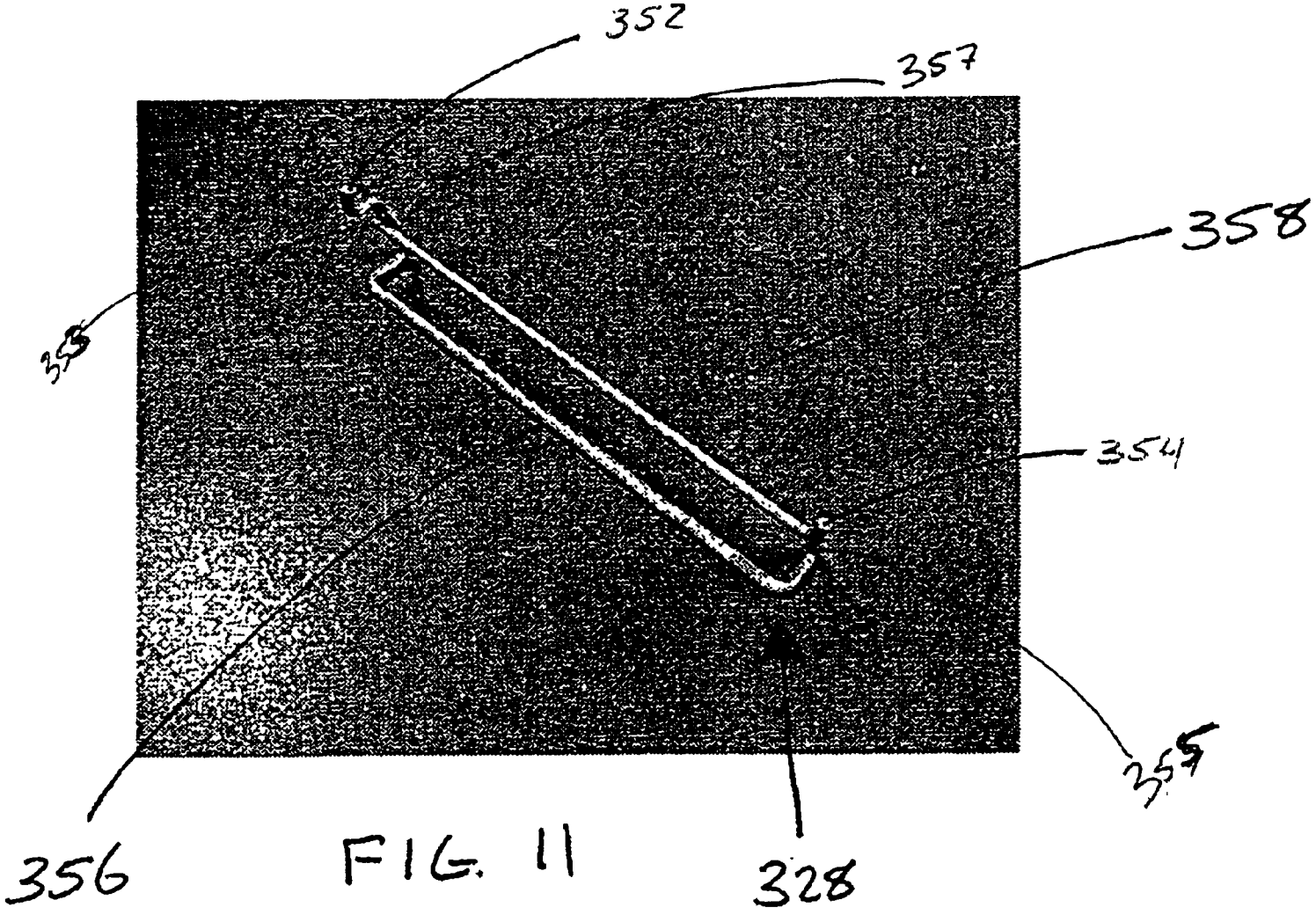
FIG. 11 is a second perspective view of a pegboard hook for a shipping case and display apparatus according to a preferred embodiment of the invention.

Hook 328 is described in more detail in connection with FIGS. 10–13. FIGS. 10–11 illustrate hook 328 in an upright orientation, having first hook end 352, second hook end 354, base portion 356, front portion 357 and support member 358. The hook ends have a partial "S" shape that is well known in the pegboard industry. Each hook end 352, 354 has a respective hook end base 353, 355. Support member 358 extends from hook end base 353 to hook end base 355.

While the hook shown in the drawings is an aspect of the preferred embodiment of the invention, other hook configurations are possible within the scope of the present invention. For example, some hook embodiments could include only one hook end, while others could include more than two hook ends.

Figure 12:
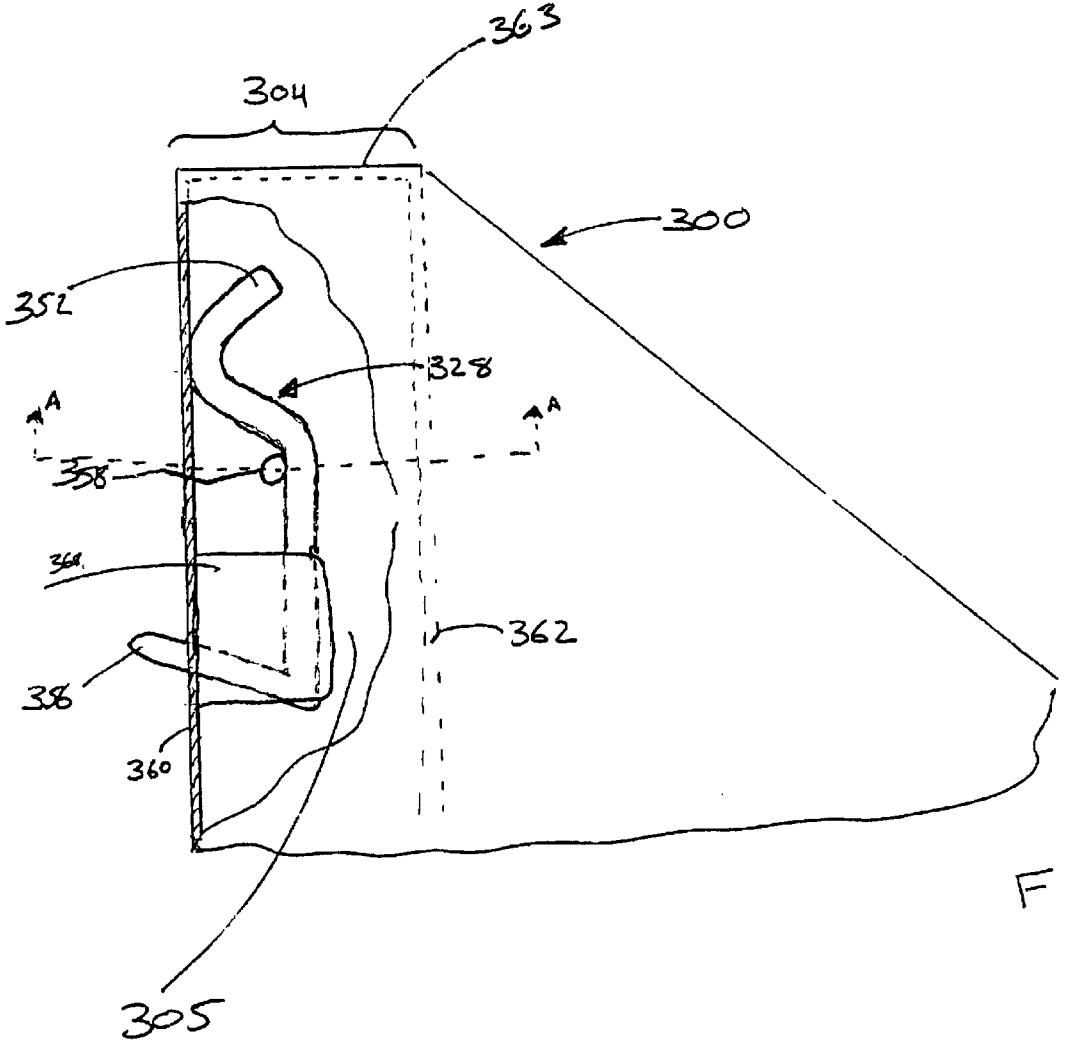
FIG. 12 is an elevated end view of a portion of a shipping case and display apparatus with an undeployed hook according to a preferred embodiment of the invention.

Referring to FIG. 12, hook 328 is shown in an undeployed orientation after it has been inserted into rear panel region 305 of tray 300. Rear panel region 305 is defined by outer rear panel 360, inner rear panel 362 and top rear panel 363. Hook end 352 and support member 358 are disposed within rear panel region 305, while base portion 356 of hook 352 is partially disposed outside outer rear panel 360. Base portion 356 passes through the space between hook retaining tab 368 and outer rear panel 360.

Figure 13:
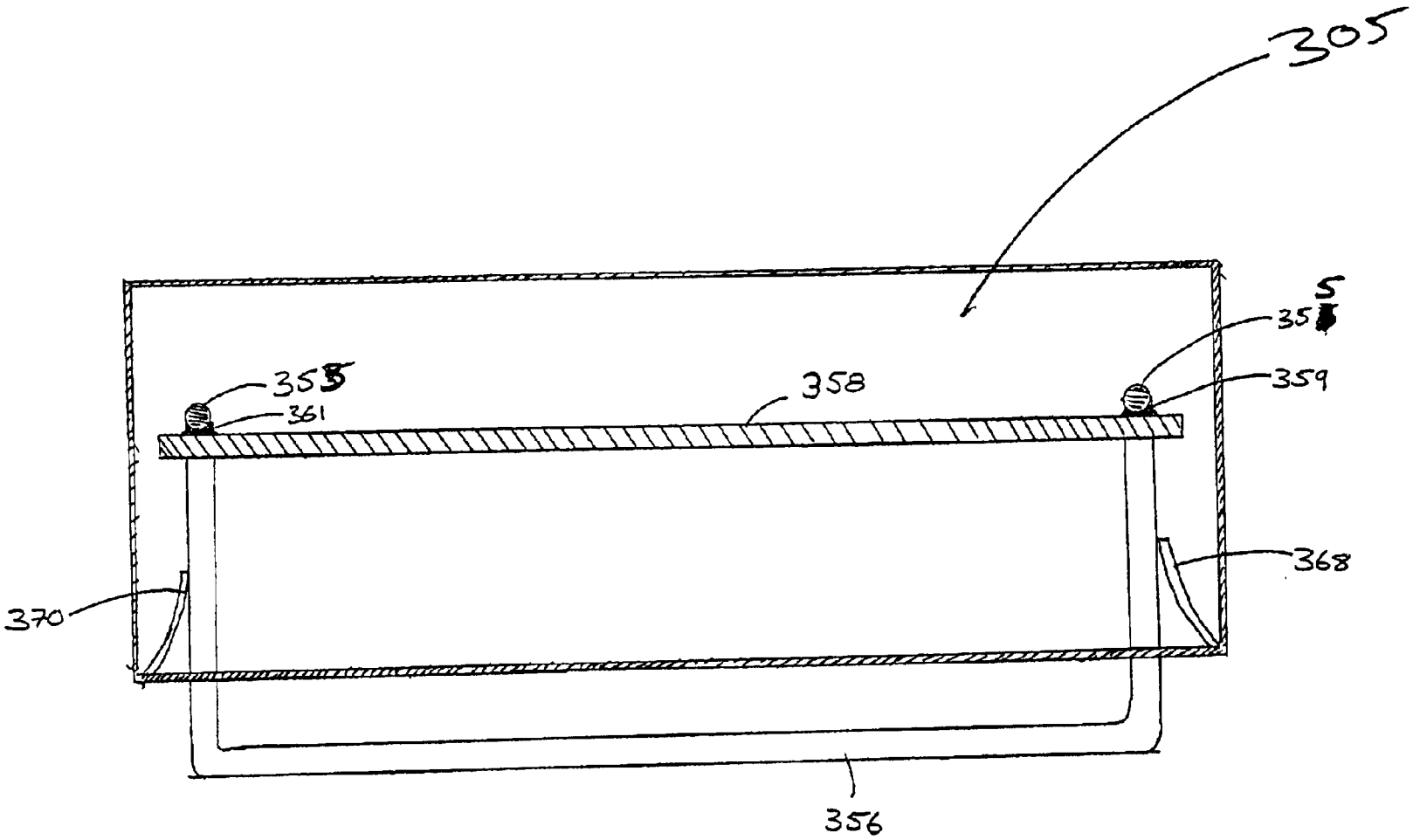
FIG. 13 is a top cross-sectional view of a shipping case and display apparatus with an undeployed hook according to a preferred embodiment of the invention taken along line A—A in FIG. 12.

Support member 358 and hook retaining tab 368 are shown in more detail in FIG. 13. Support member 358 extends from the base 353 of the first hook end to the base 355 of the second hook end. In this embodiment, support member 358 is secured to base 353 of the first hook end by weld 361. Likewise, support member 358 is secured to base 355 of the second hook end by weld 359. As will be appreciated by those skilled in the art, support member 358 may be secured to bases 353, 355 by other means, including one of gluing, riveting and forging.

Figure 14A:
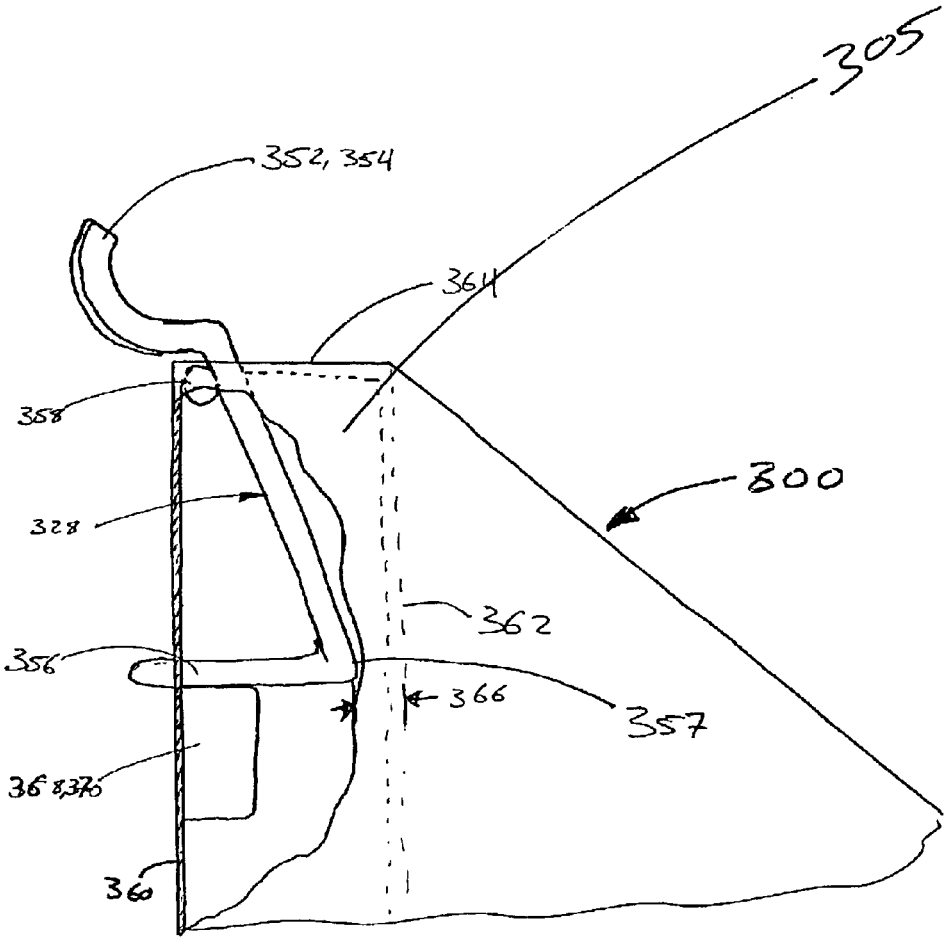
FIG. 14*a* is an elevated end view of a portion of a shipping case and display apparatus with a deployed hook according to a preferred embodiment of the invention.

As illustrated in FIG. 14*a*, hook 328 may move from its undeployed orientation to a deployed orientation. In a preferred embodiment of the invention, the hook 328 is moved from its undeployed orientation to its deployed orientation by manipulating the base portion 356, which is partially outside of rear panel region 305. In its deployed orientation, hook ends 352, 354 extend through the hook apertures (not shown) located in top rear panel 364 of tray 300. Hook retaining tabs 368, 370 engage base portion 356 of hook 328, providing support for hook 328 and allowing hook 328 to remain in its deployed orientation while tray 302 is hung. Support member 358 engages top rear panel 364, thereby maintaining the position of hook 328. In addition, front portion 357 may engage inner rear panel 362, further serving to maintain hook 328 in its second, extended configuration. However, a gap 366 may also exist between front portion 357 of hook 328 and inner rear panel 362 until the tray is hung on the peg board.

Figure 14B:
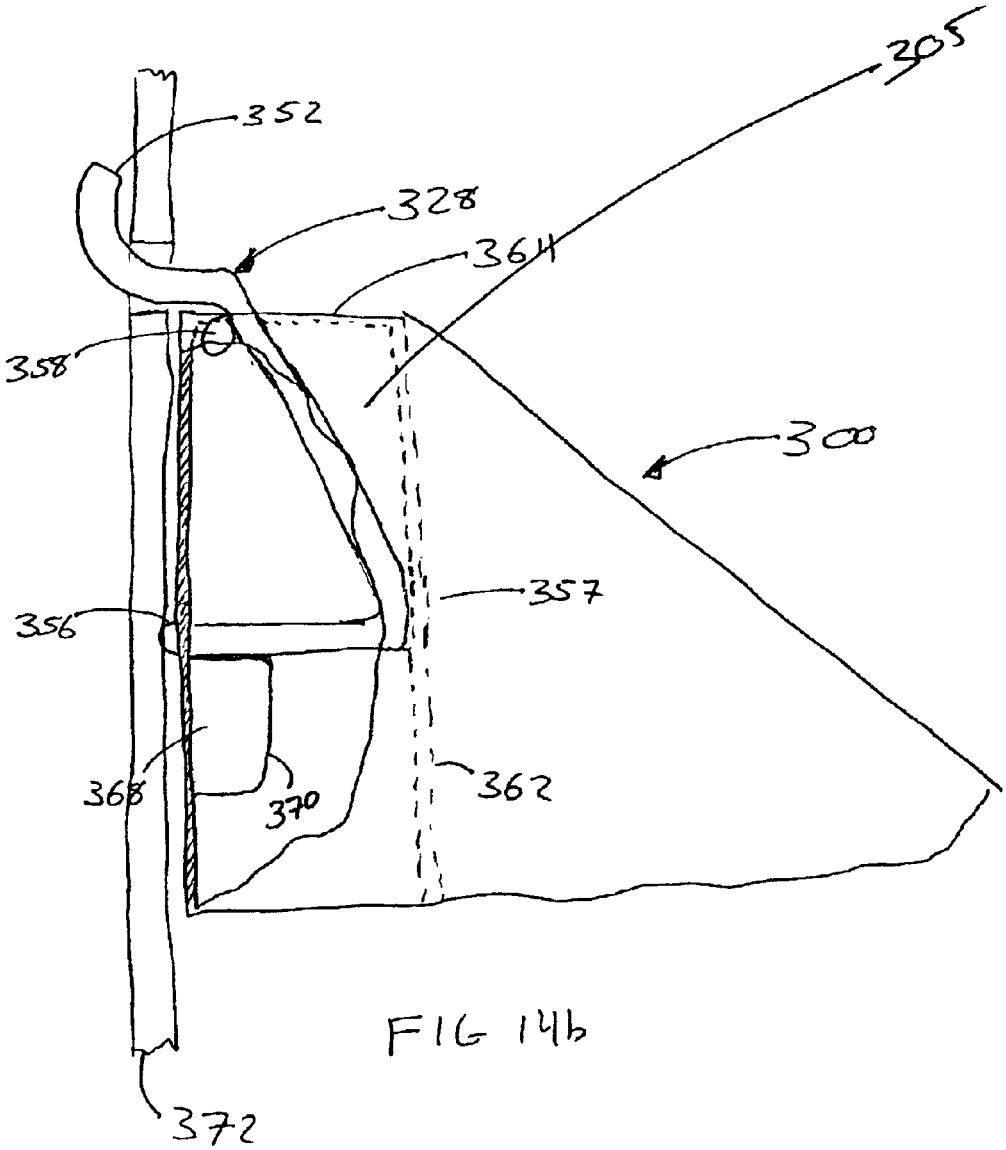
FIG. 14*b* is an elevated end view of a portion of a shipping case and display apparatus with a deployed hook and hanging from a pegboard according to a preferred embodiment of the invention.
Figure 15:
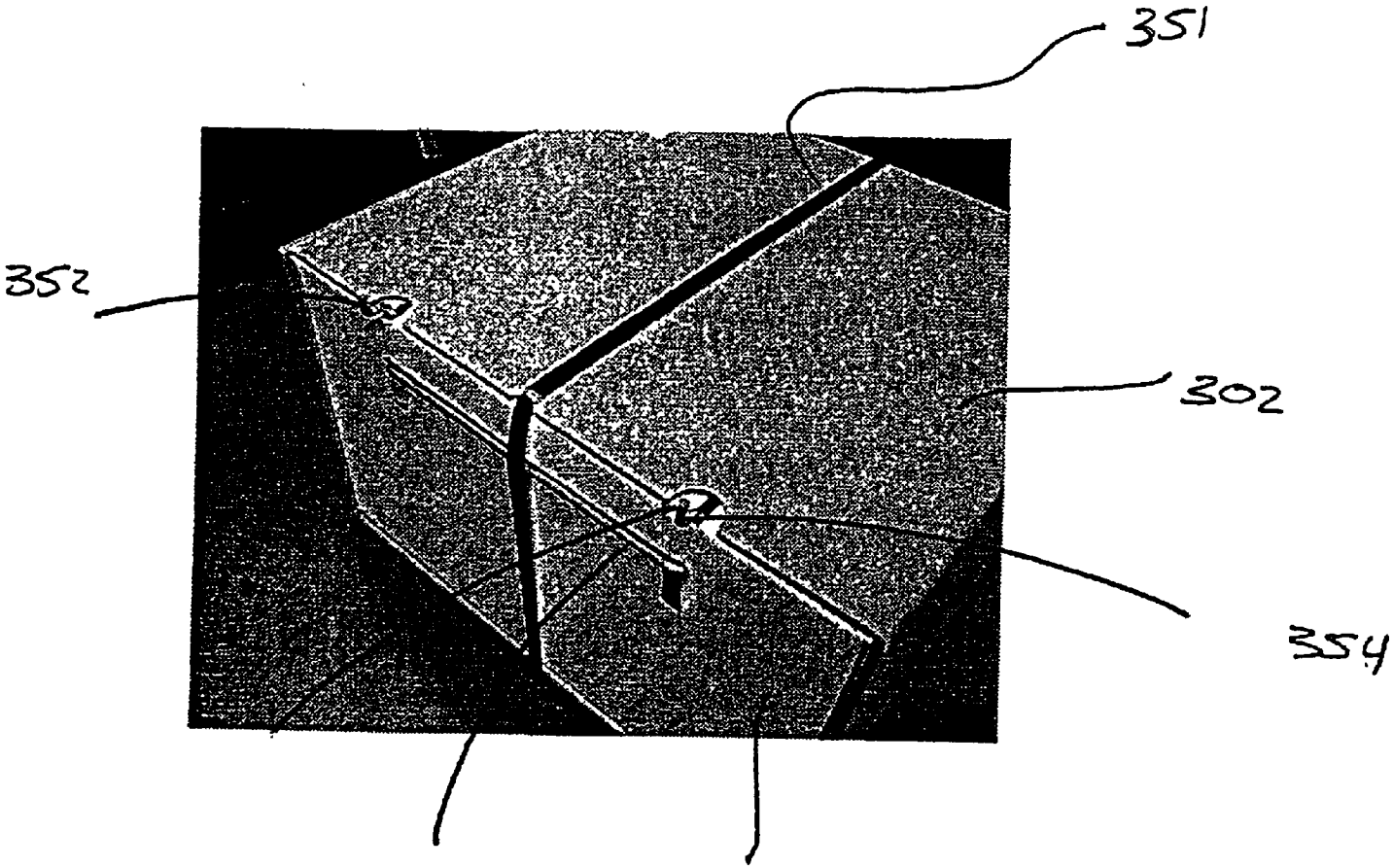
FIG. 15 is a perspective view of a assembled shipping case and display apparatus with a deployed hook according to a preferred embodiment of the invention.

Turning to FIG. 14*b*, tray 302 is shown hanging from a pegboard 372. Support member 358 engages top rear panel 364, and front portion 357 of hook 328 engages inner rear panel 360. Hook support tabs 368, 370 provide nominal support for the base portion 356 of hook 328. A perspective view of hook 328 in its second, extended configuration is provided in FIG. 15.

Figure 16:
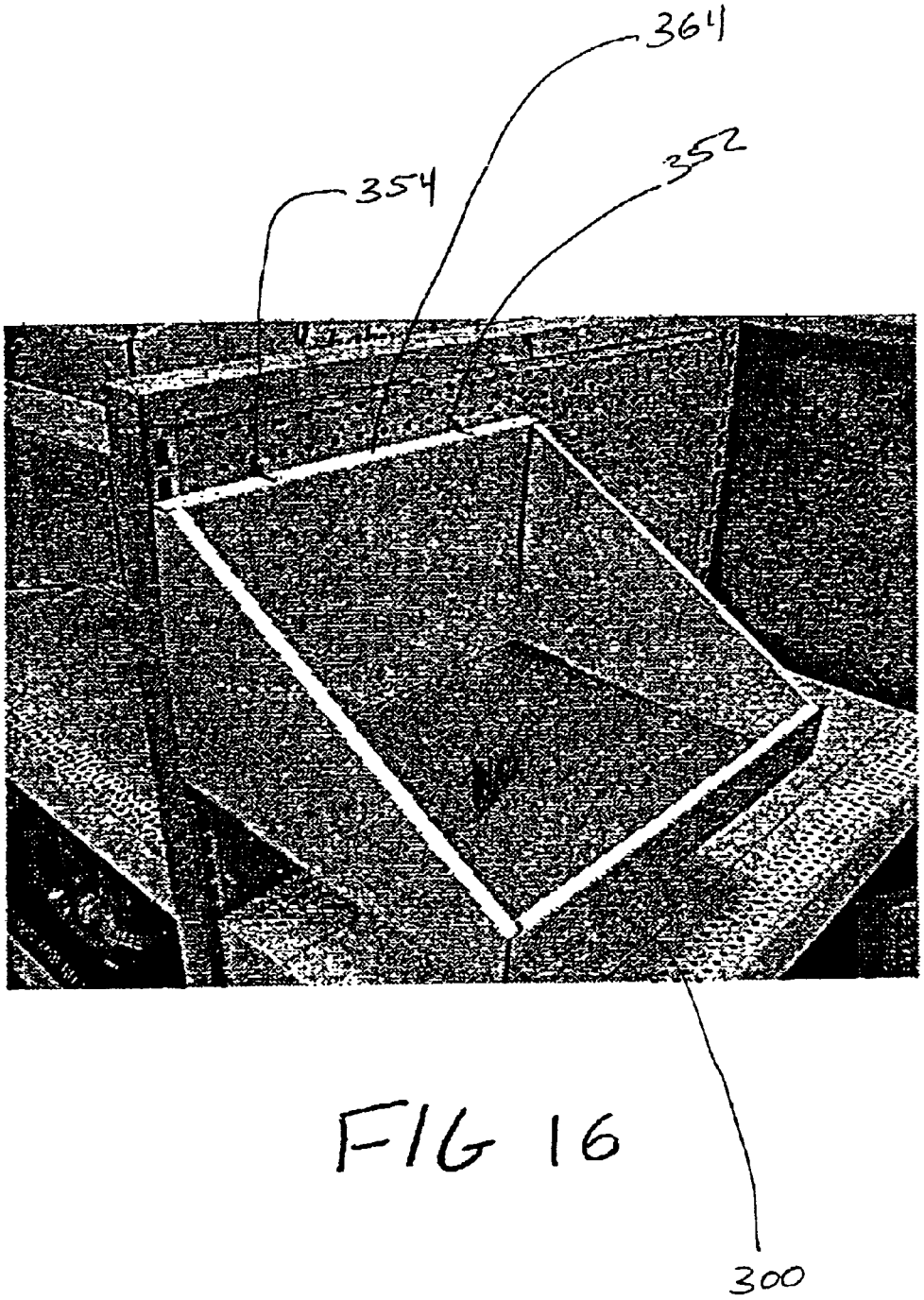
FIG. 16 is a perspective view of a tray hanging from a pegboard according to a preferred embodiment of the invention.

As will be appreciated from these drawings, the shipping and display shelf may be stocked with articles at the place of manufacture, and then sleeved and banded for shipping to a vendor. The vendor can then move hook 328 from its undeployed orientation to its deployed orientation, and hang the shipping case and display apparatus on a standard pegboard. The vendor can then cut the band and remove the sleeve. This design allows the vendor to restock its shelves without having to continuously rearrange its shelf configurations. A particular embodiment of the invention is shown hanging on a pegboard in FIG. 16.

Figure 17A:
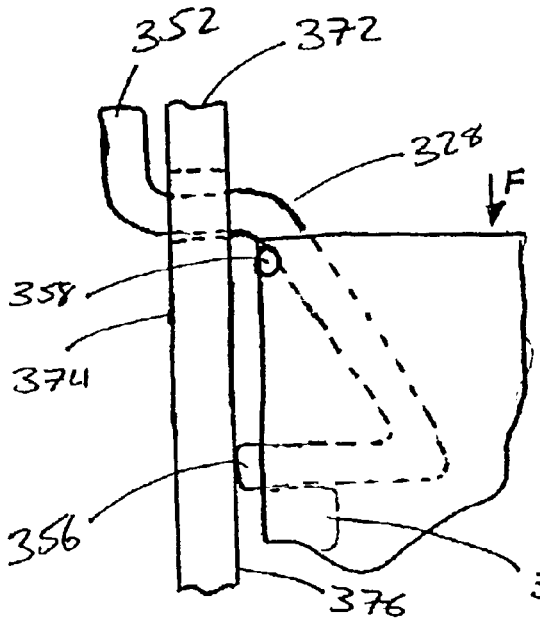
FIG. 17A is an end view of a tray hanging from a pegboard according to a preferred embodiment of the invention.
Figure 17B:
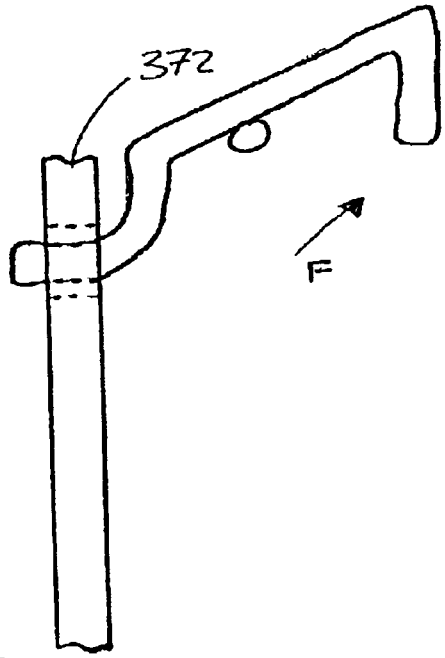
FIG. 17B is an end view of a pegboard hook being removed from a pegboard according to a preferred embodiment of the invention.

FIGS. 17*a*–17*b* further illustrate the interaction of hook 328 with pegboard 372. Pegboard 372 is typically a sturdy plywood or paperboard sheet having a series of holes disposed at regular horizontal and vertical intervals. As will be appreciated by those skilled in the art, the holes are spaced according to industry standards, such that the shelf manufacturer may know what distance(s) may separate the hook ends.

In FIG. 17*a*, first hook end 352 rests against a rear side 374 of pegboard 372, while base portion 356 rests against front side 376 of pegboard 372. When a downward force F is applied to the tray (e.g., the weight of the displaced articles), the force F is transmitted to hook 328 through support member 358. Hook 328 is constrained from moving in the downward direction by means of the contact between the hook end 352 and rear side 374 of pegboard 372, as well as the contact between base portion 356 and front side 376 of pegboard 372.

Hook 328 does move, however, in response to an upward force, as shown in FIG. 17*b*. As is well known in the art, an upward and outward force F may be used to release hook 328 from pegboard 372.

The foregoing description and drawings merely explain and illustrate the invention, the invention is not limited thereto except insofar as the appended claims are so limited as those skilled in the art having the present disclosure before will be able to make modifications and variations therein without departing from the scope of the invention.

What is claimed is:

1. A shipping case and display apparatus comprising, upon articulation, a tray, including:

a rectangular bottom panel;

a pair of side panels, foldably connected to opposing edges of the bottom panel, in a substantially perpendicular orientation relative to the bottom panel;

an outer rear panel, foldably connected to the bottom panel, in a substantially perpendicular orientation relative to the bottom panel, and substantially perpendicularly juxtaposed to the side panels;

a top rear panel, foldably connected to the outer rear panel, in a substantially perpendicular orientation relative to the outer rear panel, and substantially perpendicularly juxtaposed to the side panels, to form an enclosed rear panel region between said outer, top and inner rear panels;

an inner rear panel, foldably connected to the top rear panel in a substantially parallel orientation relative to the outer rear panel, and substantially perpendicularly juxtaposed to the side panels to form an enclosed rear panel region between said outer, top and inner rear panels;

a hook, having at least one hook end, for releasably attaching the shipping case and display apparatus to a support surface via a corresponding hook engaging aperture;

the hook being operably configured to be alternatively positionable in both an undeployed orientation, wherein the hook end is substantially enclosed within said rear panel region, and a deployed orientation, for insertion into at least a portion of said support surface to in turn, maintain said tray in a suspended orientation relative to said support surface, wherein the hook end extends through a corresponding hook aperture in the top rear panel, said hook being moveable between its deployed and undeployed orientations.

2. The shipping case and display apparatus according to claim 1, wherein the outer rear panel further includes a hook slot and at least one hook support tab.

3. The shipping case and display apparatus according to claim 2, wherein the hook is restrained in its deployed position by engaging the at least one hook support tab, the inner rear panel, and the top rear panel.

4. The shipping case and display apparatus according to claim 3, wherein, upon positioning of said tray in said suspended orientation, the inner rear panel engages a front portion of the hook, the top rear panel engages a support member of the hook, and the hook support tab engages a base portion of the hook, towards the reinforced maintenance of said tray in said suspended orientation.

5. The shipping and display apparatus according to claim 1, wherein the tray further comprises a front panel, foldably connected to the bottom panel in a substantially perpendicular orientation, and substantially perpendicularly juxtaposed to the side panels.

6. The shipping and display apparatus according to claim 1, wherein the hook further comprises:

a base portion;

a front portion;

first and second hook ends, wherein the hook ends are in the shape of a partial "S" and extend upward from the base portion; and a center support member, extending between a base of a first hook end and a base of a second hook end.

7. The shipping case and display apparatus according to claim 1, further comprising a sleeve, said sleeve being slidably positionable over the tray, said sleeve including:

a rectangular top panel;

a first rectangular side panel, foldably connected to a side edge of said top panel, in a perpendicular orientation relative to said top panel;

a rectangular bottom panel, foldably connected to an edge of said first rectangular side panel, in a perpendicular orientation relative to said first rectangular side panel;

a second rectangular side panel, foldably connected to an edge of said bottom panel, in a perpendicular orientation relative to said bottom panel, and secured to a remaining edge of said top panel; and a set of flaps, each being foldably connected to an edge of one of said top panel, first side panel, bottom panel, and second side panel, wherein the set of flaps, when folded inward, form a rear panel of the sleeve.

8. The shipping case and display apparatus according to claim 7, wherein the sleeve further comprises at least one hook notch alignable with said hook aperture, upon positioning of said sleeve about said tray.

9. The shipping case and display apparatus according to claim 7, wherein the sleeve further comprises a pair of strap notches, wherein each strap notch is disposed along the free edges of the top and bottom panels, respectively.

10. An flat blank for articulating a tray for a shipping case and display apparatus, the blank comprising:

a rectangular bottom panel having a front edge, an opposing rear edge, and a pair of opposing side edges;

an outer rear panel, foldably connected to the rear edge of the bottom panel;

a pair of outer side panel dividers, foldably connected to opposing edges of the outer rear panel;

an top rear panel, foldably connected to the rear edge of the outer rear panel;

an inner rear panel, foldably connected to the rear edge of the top rear panel;

a pair of inner side panel dividers, foldably connected to opposite edges of the inner rear panel;

a pair of inner front panel dividers, each foldably connected to a respective side edge of a respective inner side panel divider;

a pair of outer side panels, foldably connected to opposite edges of said bottom panel;

a pair of outer front panel dividers, each foldably connected to a front edge of a respective outer side panel;

a pair of top side panels, foldably connected to a side edge of the respective outer side panels;

a pair of inner side panels, foldably connected to a side edge of the respective top side panels;

an outer front panel, foldably connected to the front edge of the bottom panel;

a top front panel, foldably connected to the front edge of the outer front panel;

an inner front panel, foldably connected to the front edge of the top front panel;

a pair of front panel apertures disposed along the front edge of the bottom panel;

a pair of side panel apertures, each of which apertures is disposed along a respective side edge of the bottom panel;

a pair of hook apertures disposed in said top rear panel;

a hook slot disposed in said outer rear panel; and a pair of hook support tabs disposed in said outer rear panel, adjacent to the hook slot.

11. The blank according to claim 10, wherein the blank is monolithically formed from a single blank of substantially flat material.

12. The blank according to claim 11, wherein the single blank of substantially flat material is fabricated from at least one of the following materials: paper, paperboard and corrugated paperboard.

13. A method for shipping and displaying at least one article, comprising the steps of:

providing a blank having at least a bottom panel, a pair of side panels, an outer rear panel, and top rear panel, and an inner rear panel;

articulating the blank to form a tray having at least a rectangular bottom panel, a pair of side panels foldably connected to opposite edges of the bottom panel in a substantially perpendicular orientation relative to the bottom panel, an outer rear panel foldably connected to the bottom panel in a substantially perpendicular orientation relative to the bottom panel and substantially perpendicularly juxtaposed to the side panels, an top rear panel foldably connected to the outer rear panel in a substantially perpendicular configuration to the outer rear panel and perpendicularly juxtaposed to the side panels, an inner rear panel foldably connected to the top rear panel in a substantially perpendicular orientation with respect to the top rear panel and substantially perpendicularly juxtaposed to the side panels, and a rear panel region defined by said outer, top and inner rear panels;

providing a hook substantially enclosed within the rear panel region oriented in an undeployed position suitable for shipping;

loading the tray with product;

providing a sleeve in the form of a five-sided box;

sliding the sleeve over the tray and its contents;

binding the sleeve and tray together with a strap;

shipping the apparatus to a vendor;

receiving the apparatus at the vendor;

orienting the hook in a deployed position wherein at least one hook end protrudes from the shipping and display appratus in a configuration suitable for hanging the tray from a vertical support surface having a corresponding hook engaging aperture;

hanging the shipping and display apparatus from the vertical support surface by inserting the at least one hook end into the corresponding hook engaging aperture;

removing the strap; and removing the sleeve.

14. The method of claim 13, further comprising the step of positioning the hook in the rear panel region before the tray is articulated.

15. The method of claim 13, further comprising the step of positioning the hook in the rear panel region after the tray is articulated.

* * * * *